US011312127B2

(12) United States Patent
Kim et al.

(10) Patent No.: US 11,312,127 B2
(45) Date of Patent: Apr. 26, 2022

(54) APPARATUS FOR DISCHARGING CHEMICAL LIQUID AND METHOD OF DISCHARGING CHEMICAL LIQUID

(71) Applicant: Semes Co., Ltd., Cheonan-si (KR)

(72) Inventors: Chulwoo Kim, Cheonan-si (KR); Beomjeong Oh, Cheonan-si (KR)

(73) Assignee: Semes Co., Ltd., Cheonan-si (KR)

( * ) Notice: Subject to any disclaimer, the term of this patent is extended or adjusted under 35 U.S.C. 154(b) by 14 days.

(21) Appl. No.: 16/868,633

(22) Filed: May 7, 2020

(65) Prior Publication Data

US 2020/0361204 A1 Nov. 19, 2020

(30) Foreign Application Priority Data

May 14, 2019 (KR) ..... 10-2019-0056017

(51) Int. Cl.
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586
See application file for complete search history.

(56) References Cited

U.S. PATENT DOCUMENTS

| | | | | |
|---|---|---|---|---|
| 7,823,535 | B2 * | 11/2010 | Hanafusa | B01L 3/0268 118/665 |
| 8,596,739 | B2 * | 12/2013 | Lee | B41J 25/003 347/9 |
| 10,807,358 | B2 * | 10/2020 | Byun | B41J 2/04508 |
| 11,009,338 | B2 * | 5/2021 | Suemasu | G01B 11/303 |

FOREIGN PATENT DOCUMENTS

| | | | |
|---|---|---|---|
| JP | 2012-200703 | A | 10/2012 |
| KR | 2004-0026093 | A | 3/2004 |
| KR | 2005-0099134 | A | 10/2005 |
| KR | 2010-0093827 | A | 8/2010 |
| KR | 2011-0058566 | A | 6/2011 |
| KR | 10-2011-0136746 | A | 12/2011 |
| KR | 2016-0109631 | A | 9/2016 |

* cited by examiner

*Primary Examiner* — Thinh H Nguyen
(74) *Attorney, Agent, or Firm* — Daly Crowley Mofford & Durkee, LLP

(57) ABSTRACT

An apparatus for discharging chemical liquid may include an ink jet head, a gantry and a control member. The ink jet head may include a plurality of nozzles capable of discharging chemical liquid onto a substrate. The gantry may hold the ink jet head to place the ink jet head over the substrate. The control member may control the ink jet head such that discharge times of the chemical liquid from the nozzles of the ink jet head may be changed.

6 Claims, 3 Drawing Sheets

APPARATUS FOR DISCHARGING CHEMICAL LIQUID AND METHOD OF DISCHARGING CHEMICAL LIQUID

CROSS-REFERENCE TO RELATED APPLICATION

This application claims priority to Korean Patent Application No. 10-2019-0056017 filed on May 14, 2019 in the Korean Intellectual Property Office (KIPO), the contents of which are herein incorporated by reference in its entirety.

BACKGROUND

1. Field

Example embodiments of the invention relate to an apparatus for discharging chemical liquid and a method of discharging chemical liquid. More particularly, example embodiments of the invention relate to an apparatus for discharging chemical liquid capable of discharging chemical liquid onto a substrate using an ink jet head including a plurality of nozzles, and a method of discharging chemical liquid using such apparatus for discharging chemical liquid.

2. Related Technology

In processes for manufacturing a display device such as a liquid crystal display device or an organic light emitting display device, discharge points of chemical liquid on a substrate are exactly managed so as to precisely form pixel regions of the substrate. To discharge the chemical liquid onto the substrate, a conventional apparatus for discharging chemical liquid can include an ink jet head including a plurality of nozzles. Generally, the ink jet head may be hold by a gantry such that the ink jet head may be placed over the substrate.

However, the gantry may be distorted because of the installation of the ink jet head on the gantry, the thermal deformation of the gantry, etc. As a result, the chemical liquid cannot be exactly discharged from the ink jet head supported by such a gantry onto desired portions of the substrate, namely, the pixel regions of the substrate.

SUMMARY

It is an object of the invention to provide an apparatus for discharging chemical liquid capable of exactly discharging chemical liquid onto desired portions of a substrate even though a gantry is distorted.

It is another object of the invention to provide a method of discharging chemical liquid which can exactly discharge chemical liquid onto desired portions of a substrate even though a gantry is distorted.

According to one aspect of the invention, there is provided an apparatus for discharging chemical liquid comprising an ink jet head including a plurality of nozzles for discharging chemical liquid onto a substrate, a gantry for holding the ink jet head to place the ink jet head over the substrate, and a control member for controlling the ink jet head such that discharge times of the chemical liquid from each of the nozzles of the ink jet head are changed.

In example embodiments, the apparatus for discharging chemical liquid may additionally include a stage on which the substrate is placed and an alignment mark formed on the stage. In this case, an alignment between the gantry and the stage may be identified using the alignment mark.

In some example embodiments, the apparatus for discharging chemical liquid may additionally include an alignment mark formed on the substrate. In this case, an alignment between the gantry and the stage may be identified using the alignment mark.

According to another aspect of the invention, there is provided a method of discharging chemical liquid which includes discharging chemical liquid onto a substrate using an ink jet head including a plurality of nozzles wherein the ink jet head is placed over the substrate and supported by a gantry, and controlling the ink jet head such that discharge times of the chemical liquid from the nozzles of the ink jet head are changed when the chemical liquid is discharged onto the substrate.

According to example embodiments, the method of discharging chemical liquid may additionally include identifying an alignment of the gantry prior to the discharging of the chemical liquid onto the substrate. In example embodiments, the identifying of the alignment of the gantry may be performed using an alignment mark formed on a stage on which the substrate is placed. In some example embodiments, wherein the identifying of the alignment of the gantry may be performed using an alignment mark formed on the substrate.

According to example embodiments of the invention, when the chemical liquid is discharged onto the substrate, the discharge times of the chemical liquid from the nozzles of the ink jet head may be changed, and thus the chemical liquid may be exactly discharged onto desired portions of the substrate even though the gantry is distorted. Therefore, a display devices having high resolution may be advantageously manufactured by exactly discharging the chemical liquid onto closely arranged pixel regions of the substrate.

BRIEF DESCRIPTION OF THE DRAWINGS

Example embodiments will be more clearly understood from the following detailed description taken in conjunction with the accompanying drawing. The following figures represent non-limiting, example embodiments as described herein.

DESCRIPTION OF EMBODIMENTS

Figure 1:
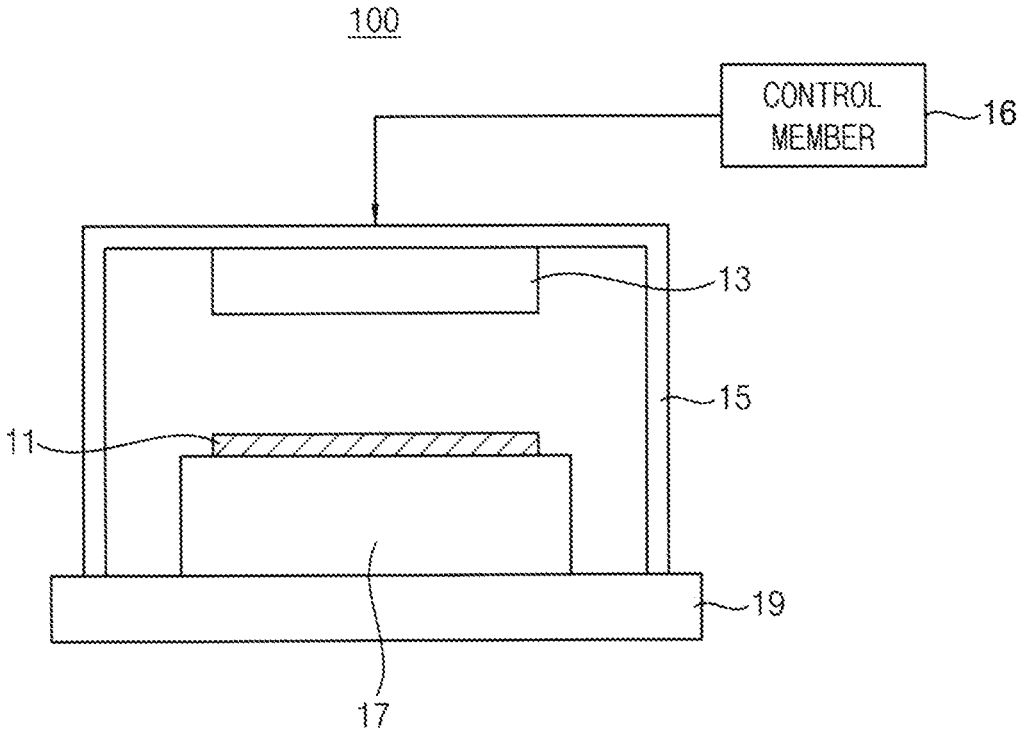
FIG. 1 illustrates a schematic configuration of an apparatus for discharging chemical liquid in accordance with example embodiments of the invention.

Various embodiments will be described more fully hereinafter with reference to the accompanying drawings, in which some embodiments are shown. The invention may, however, be embodied in many different forms and should not be construed as limited to the embodiments set forth herein. Rather, these embodiments are provided so that this description will be thorough and complete, and will fully convey the scope of the invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (for example, rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include a plurality of forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-sectional illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the face through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, it will be described an apparatus for discharging chemical liquid according to example embodiments with reference to the accompanying drawings.

Figure 2:
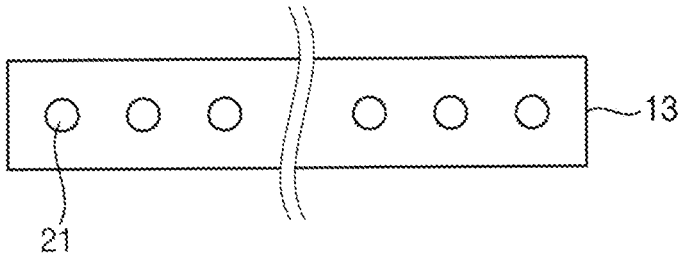
FIG. 2 illustrates a schematic configuration of an ink jet head included in the apparatus for discharging chemical liquid.

FIG. 1 illustrates a schematic configuration of an apparatus for discharging chemical liquid in accordance with example embodiments of the invention. FIG. 2 illustrates a schematic configuration of an ink jet head included in the apparatus for discharging chemical liquid.

Referring to FIGS. 1 and 2, an apparatus for discharging chemical liquid 100 according to example embodiments may include an ink jet head 13, a gantry 15, a control member 16, a stage 17, a base 19, etc.

The ink jet head 13 may supply chemical liquid onto an object such as a substrate 11. In example embodiments, the ink jet head 13 may include a plurality of nozzles 21 capable of discharging the chemical liquid onto the substrate 11. Here, the plurality of nozzles 21 may be arranged on a bottom face of the ink jet head 13 by substantially equal distances. In some example embodiments, the ink jet head 13 may include a plurality of piezoelectric elements (not illustrated). The plurality of piezoelectric elements may be corresponded to the plurality of nozzles 21, respectively. For example, the number of the piezoelectric elements may be substantially the same as the number of the nozzles 21. The plurality of piezoelectric elements may be disposed at the plurality of nozzles 21. The chemical liquid may be discharged onto the substrate 11 through the nozzles 21 by the operations of the piezoelectric elements. That is, each of the piezoelectric elements may operate to supply the chemical liquid onto the substrate 11 through each of the nozzles 21. In this case, the amounts of the chemical liquid discharged from the nozzles 21 may be independently adjusted by controlling the voltages applied to the piezoelectric elements, respectively.

In manufacturing processes for a display device using the apparatus for discharging chemical liquid 100 according to example embodiments, the chemical liquids may be discharged from the plurality of nozzles 21 of the ink jet head 13 to pixel regions of the substrate 11, respectively.

Referring now to FIGS. 1 and 2, the gantry 15 of the apparatus for discharging chemical liquid 100 may hold the ink jet head 13. The gantry 15 may have a structure enclosing the base 19 and the stage 17. The gantry 15 may support the ink jet head 13 such that the ink jet head 13 may be disposed over the substrate 11. For example, the gantry 15 may hold the ink jet head 13 so that the ink jet head 13 may substantially face the substrate 11 placed on the stage 17. Therefore, the chemical liquid may be discharged from the ink jet head 13 toward the substrate 11. In some example embodiments, the apparatus for discharging chemical liquid 100 may include a plurality of ink jet heads 13 supported by the gantry 15. Here, the plurality of ink jet heads 13 may be disposed in a substantial line over the stage 17.

The control member 16 may control the ink jet head 13 such that discharge times of the chemical liquid from each of the nozzles 21 of the ink jet head 13 may be changed. In other words, the control member 16 may control the ink jet head 13 to change times for which the chemical liquid is discharged from the nozzles 21 of the ink jet head 13. For example, the control member 16 may control individually each of the nozzles 21 of the ink jet head 13 such that the chemical liquid may be discharged onto the substrate 11 from the nozzles 21 by predetermined time intervals.

While the chemical liquid is discharged onto the substrate 11 using the apparatus for discharging chemical liquid 100, the control member 16 may independently control the operations of the piezoelectric element disposed at the nozzles 21 of the ink jet head 13 to thereby change the discharge times of the chemical liquid from the nozzles 21 of the ink jet head 13. That, the chemical liquid may be supplied onto at different times by the control member 16. When the chemical liquid is supplied onto the substrate 11, the gantry 15 may be distorted because of the installation of the ink jet head 13 on the gantry 15 and/or the thermal deformation of the gantry 15. If the chemical liquid is discharged onto the substrate 11 from the ink jet head 13 supported by such distorted gantry 15, the chemical liquid may not be exactly supplied from the nozzles 21 of the ink jet head 13 onto the pixel regions of the substrate 11. As a result, desired pixels may not be formed on the substrate 11. In other words, the ink jet head 13 supported by the gantry 15 may be distorted in accordance with the distortion of the gantry 15, and thus the positions of the nozzles 21 of the ink jet head 13 may be varied with respect to the substrate 11. As a result, the chemical liquid may not be provided from the nozzles 21 of the ink jet head 13 to the exact discharge points of the substrate 11.

Considering the above-mentioned problem, the apparatus for discharging chemical liquid 100 according to example embodiments may include the control member 16 so that the apparatus for discharging chemical liquid 100 may change the discharge times of the chemical liquid from the nozzles 21 of the ink jet head 13 while discharging the chemical liquid onto the substrate 11. Accordingly, the apparatus for discharging chemical liquid 100 may exactly discharge the chemical liquid into desired portions of the substrate 11, namely the pixel regions of the substrate 11 from the nozzles 21 of the ink jet head 13 hold by the distorted gantry 15 when the gantry 15 is distorted as described above. In other words, the apparatus for discharging chemical liquid 100 including the control member 16 may change the discharge times of the chemical liquid from the nozzles 21 of the ink jet head 13 such that the chemical liquid may be exactly discharged onto the desired portions of the substrate 11 by correcting the discharge points of the substrate 11 where the chemical liquid is supplied from the nozzles 21.

Figure 3:
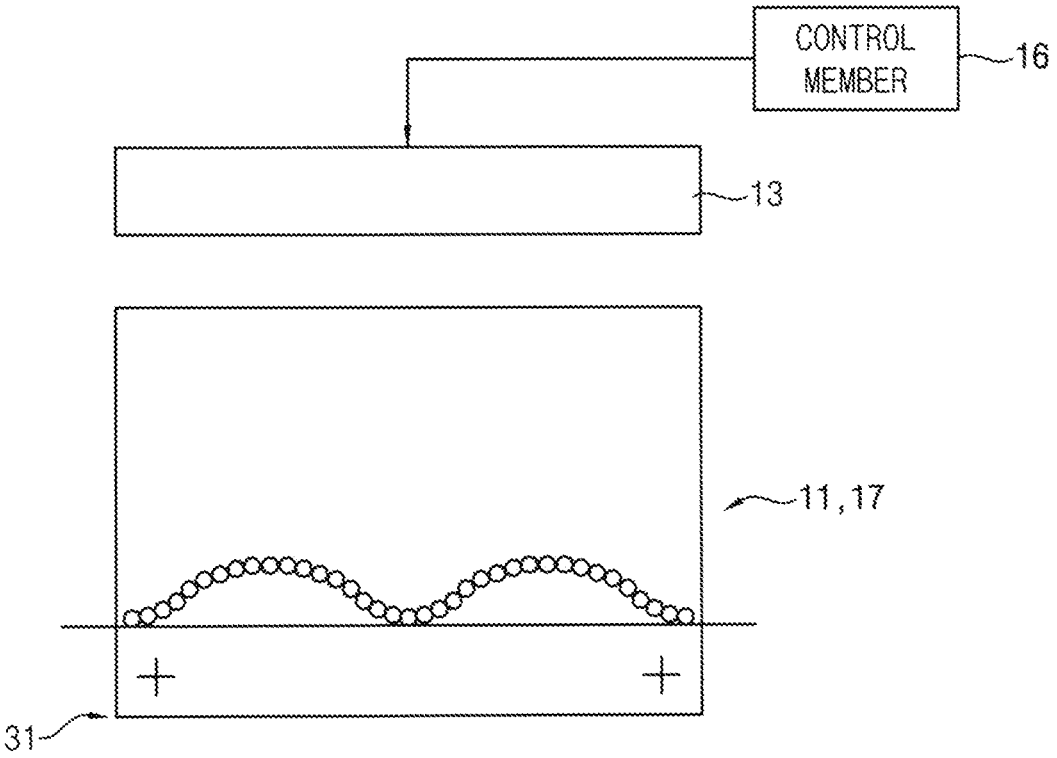
FIGS. 3 and 4 illustrate schematic configurations for describing a method of discharging chemical liquid in accordance with example embodiments of the invention.
Figure 4:
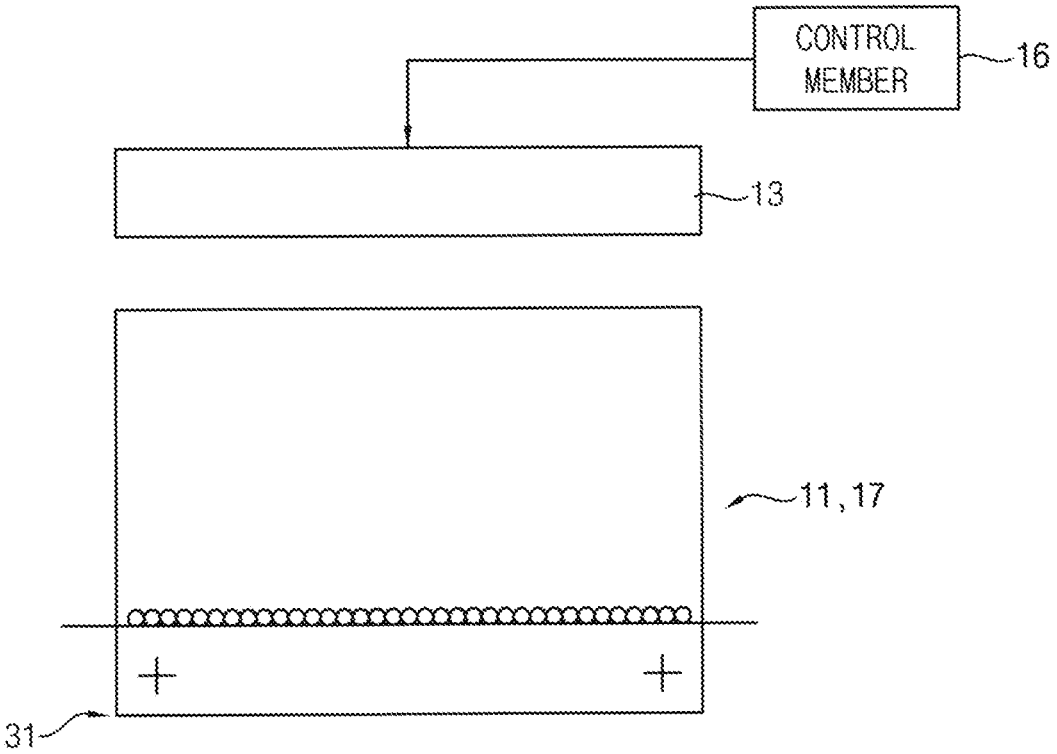

FIGS. 3 and 4 illustrate a method of discharging chemical liquid in accordance with example embodiments of the invention.

Referring to FIG. 3, when the chemical liquid may be discharged onto the substrate 11 from the ink jet head 13 at the same discharge time, the chemical liquid may be supplied onto a first portion of the substrate 11 from the nozzles 21 of the ink jet head 13 supported by a forwardly distorted first portion of the gantry 15. In addition, the chemical liquid may be supplied onto a second portion of the substrate 11 from the nozzles 21 of the ink jet head 13 supported by a backwardly distorted second portion of the gantry 15. Here, the second portion of the substrate 11 may be out of line with the first portion of the substrate 11 because of the forwardly distorted first portion of the gantry 15 and the backwardly distorted second portion of the gantry 15. Although the nozzles 21 of the ink jet head 13 may be arranged in a line, the chemical liquid may not be discharged in a line onto the substrate 11 due to the distortion of the gantry 15 such that the chemical liquid may be supplied onto the first and the second portions of the substrate 11.

Referring to FIG. 4, the control member 16 may control the ink jet head 16 to change the discharge times of the chemical liquid from the nozzles 21 of the ink jet head 13 onto the substrate 11. In example embodiments, the control member 16 may control the ink jet head 13 so that the chemical liquid may be supplied at first discharge times from the nozzles 21 of the ink jet head 13 supported by the forwardly distorted first portion of the gantry 15. Further, the control member 16 may control the ink jet head 13 such that the chemical liquid may be supplied at second discharge times from the nozzles 21 of the ink jet head 13 supported by the backwardly distorted second portion of the gantry 15. In this case, the second discharge times of the chemical liquid may be relatively faster than the first discharge times of the chemical liquid. Accordingly, the chemical liquid may be exactly discharged onto the desired portions of the substrate 11, namely the pixel regions of the substrate 11. In other words, since the discharge times of the chemical liquid discharged from the nozzles 21 of the ink jet head 13 may be varied by the control member 16, the chemical liquid may be exactly supplied onto the desired portions of the substrate 11 from the nozzles 21 of the ink jet head 13 even though the gantry 15 is distorted.

Referring now to FIGS. 1 and 2, the substrate 11 may be placed on the stage 17. For example, the stage 17 may support the substrate 11 placed thereon while the chemical liquid is discharged onto the substrate 11 from the nozzles 21 of the ink jet head 13. In this case, the base 19 may support the stage 17 and the gantry 15.

Referring now to FIGS. 3 and 4, the apparatus for discharging chemical liquid 100 may include an alignment mark 31 formed on the stage 17. In other example embodiments, the apparatus for discharging chemical liquid 100 may include an alignment mark 31 formed on the substrate 11. Using such alignment mark 31 formed on the stage 17 or the substrate 11, the alignment of the gantry 15 and the stage 17 may be identified before the chemical liquid is discharged from the nozzles 21 of the ink jet head 13 onto the substrate 11. The degree of distortion of the gantry 15 may be determined by identifying such alignment of the gantry 15 and the stage 17. Accordingly, the discharge times of the chemical liquid from the nozzles 21 of the ink jet head 13 may be more precisely adjusted using the control member 16.

In example embodiments, the chemical liquid may be discharged onto the substrate 11 from the nozzles 21 of the ink jet head 13 while the substrate 11 is transferred in a state where the gantry 15 is fixed on the base 19 in the processes for supplying the chemical liquid onto the substrate 11 using the apparatus for discharging chemical liquid 100. That is, the chemical liquid may be discharged onto the substrate 11 from the nozzles 21 of the ink jet head 13 hold by the gantry 15 while the substrate 11 moves under the gantry 15. In this case, the control member 16 may adjust the discharge times of the chemical liquid supplied onto the substrate 11 which can move under the gantry 15, so that the ink jet head 13 may exactly discharging the chemical liquid onto the desired portions of the substrate 11.

In some example embodiments, the chemical liquid may be discharged onto the substrate 11 from the nozzles 21 of the ink jet head 13 while the gantry 15 is moved in a state where the stage 17 having the substrate 11 thereon is fixed on the base 19 in the processes for supplying the chemical liquid onto the substrate 11 using the apparatus for discharging chemical liquid 100. In other words, the chemical liquid may be discharged onto the substrate 11 from the nozzles 21 of the ink jet head 13 supported by the gantry 15 while the gantry 15 moves over the substrate 11 placed on the stage 17. Here, the control member 16 may adjust the discharge times of the chemical liquid provided onto the substrate 11 while the gantry 15 moves over the substrate 11, so that the ink jet head 13 may exactly discharging the chemical liquid onto the desired portions of the substrate 11.

In the apparatus for discharging chemical liquid 100 according to example embodiments, when the chemical liquid is supplied from the ink jet head 13 onto the substrate 11, the control section 16 may change the discharge times of the chemical liquid from the nozzles 21 of the ink jet head 13 such that the ink jet head 13 may exactly discharge the chemical liquid onto the pixel regions of the substrate 11 although the gantry 15 is distorted.

In the method of discharging chemical liquid according to example embodiments, the chemical liquid may be discharged onto the substrate 11 using the ink jet head 13 including the plurality of nozzles 21, which may be placed over the substrate 11 and may be hold by the gantry 15. When the chemical liquid is discharged onto the substrate 11, the discharge times of the chemical liquid from the nozzles 21 of the ink jet head 13 may be changed by the control member 16. Further, the alignment of the gantry 15 may be identified before the chem. Is discharged onto the substrate 11. The identifying of the alignment of the gantry 15 may be performed using the alignment mark 31 formed on the stage 17 on which the substrate 11 is placed, or may be performed the alignment mark 31 formed on the substrate 11. The degree of distortion of the gantry 15 may be determined using the alignment mark 31, and thus the chemical liquid may be exactly discharged onto the desired portions of the substrate 11 by the control section member 16 which can change the discharge times of the chemical liquid from the nozzles 21 of the ink jet head 13.

According to example embodiments of the invention, recent display devices having high resolution may be advantageously manufactured because the chemical liquid may be exactly discharged onto the closely arranged pixel regions of the substrate.

As described above, it was identified that the chemical liquid supply assembly of the invention could provide the ink jet heads with the chemical liquid at significantly uniform flow rate in comparison with the conventional chemical liquid supply assembly. Accordingly, the chemical liquid supply assembly of the invention may be advantageously used in processes for manufacturing an integrated circuit device such as a display device, a semiconductor device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. An apparatus for discharging chemical liquid comprising:

an ink jet head including a plurality of nozzles for discharging chemical liquid onto a substrate;

a gantry that is arranged to move the ink jet head over the substrate; and a control member that is arranged to control any of the plurality of nozzles individually, the control member being arranged to compensate for a distortion of the gantry by adjusting respective discharge times of at least some of the plurality of nozzles.

2. The apparatus for discharging chemical liquid of claim 1, further comprising a stage on which the substrate is placed and an alignment mark formed on the stage wherein the control member is further configured to detect the distortion of the gantry based on the alignment mark.

3. The apparatus for discharging chemical liquid of claim 1, further comprising an alignment mark formed on the substrate wherein the control member is further configured to detect the distortion of the gantry based on the alignment mark.

4. A method of discharging chemical liquid comprising:

detecting a distortion of a gantry that is configured to support an inkjet head over a substrate, the inkjet head including a plurality of nozzles; and discharging chemical liquid onto the substrate by using the ink jet head, the discharging including individually adjusting respective discharge times of at least some of the plurality of nozzles to compensate for the distortion of the gantry.

5. The method of claim 4, wherein the distortion is identified by using an alignment mark formed on a stage on which the substrate is placed.

6. The method of claim 4, wherein the distortion is identified by using an alignment mark formed on the substrate.

* * * * *